US009350094B2

(12) United States Patent
Lhommeau et al.

(10) Patent No.: US 9,350,094 B2
(45) Date of Patent: May 24, 2016

(54) ELECTRICAL CIRCUIT FOR THE INTERCONNECTION OF AN ELECTRICAL COMPONENT, SUCH AS A POWER COMPONENT

(71) Applicant: LABINAL POWER SYSTEMS, Blagnac (FR)

(72) Inventors: Tony Lhommeau, Lieusaint (FR); Stephane Sorel, Soisy sur Seine (FR)

(73) Assignee: LABINAL POWER SYSTEMS, Blagnac (FR)

( * ) Notice: Subject to any disclaimer, the term of this patent is extended or adjusted under 35 U.S.C. 154(b) by 0 days.

(21) Appl. No.: 14/402,181

(22) PCT Filed: May 30, 2013

(86) PCT No.: PCT/FR2013/051223

§ 371 (c)(1),
(2) Date: Nov. 19, 2014

(87) PCT Pub. No.: WO2013/178957

PCT Pub. Date: Dec. 5, 2013

(65) Prior Publication Data

US 2015/0126049 A1 May 7, 2015

(30) Foreign Application Priority Data

Jun. 1, 2012 (FR) ..... 1255117

(51) Int. Cl.

| | |
|---|---|
| ***H01R 12/00*** | (2006.01) |
| ***H01R 12/61*** | (2011.01) |
| ***H01R 12/57*** | (2011.01) |
| ***H01R 12/59*** | (2011.01) |

(52) U.S. Cl.

CPC ..... *H01R 12/616* (2013.01); *H01R 12/57* (2013.01); *H01R 12/592* (2013.01)

(58) Field of Classification Search

CPC .... H01R 12/616; H01R 12/57; H01R 12/592; H01R 12/585

USPC ..... 439/67

See application file for complete search history.

(56) References Cited

U.S. PATENT DOCUMENTS 4,530,551 A * 7/1985 Benasutti ..... H01R 9/091 439/738

4,595,248 A 6/1986 Brown (Continued)

FOREIGN PATENT DOCUMENTS

EP 1 705 751 A1 9/2006
WO 2007/087982 A1 8/2007

OTHER PUBLICATIONS

International Search Report issued Sep. 18, 2013, in PCT/FR2013/051223, filed May 30, 2013.

*Primary Examiner* — Jean F Duverne

(74) *Attorney, Agent, or Firm* — Oblon, McClelland, Maier & Neustadt, L.L.P.

(57) ABSTRACT

An electrical circuit including at least one electrical component, such as a power component, and an electrical flex circuit, and at least one electrical conductor part connecting the electrical component to the flex circuit, the electrical conductor part including at least a first contact portion configured to receive in contact a contact element of the electrical power component and a second contact portion configured to receive in contact a conductive layer of the electrical flex circuit, the extent of the width of the second contact portion corresponding to the width of the flex circuit, and the extent of the length of same being adjusted to provide a contact surface that one of transmitting a density of electrical current of between 4.5 and 5.5 A/mm$^2$ and allowing the electrical circuit to support a current specific to the power component, i.e. between 30 and 80 A.

11 Claims, 1 Drawing Sheet

(56) References Cited

U.S. PATENT DOCUMENTS

Figure 1:
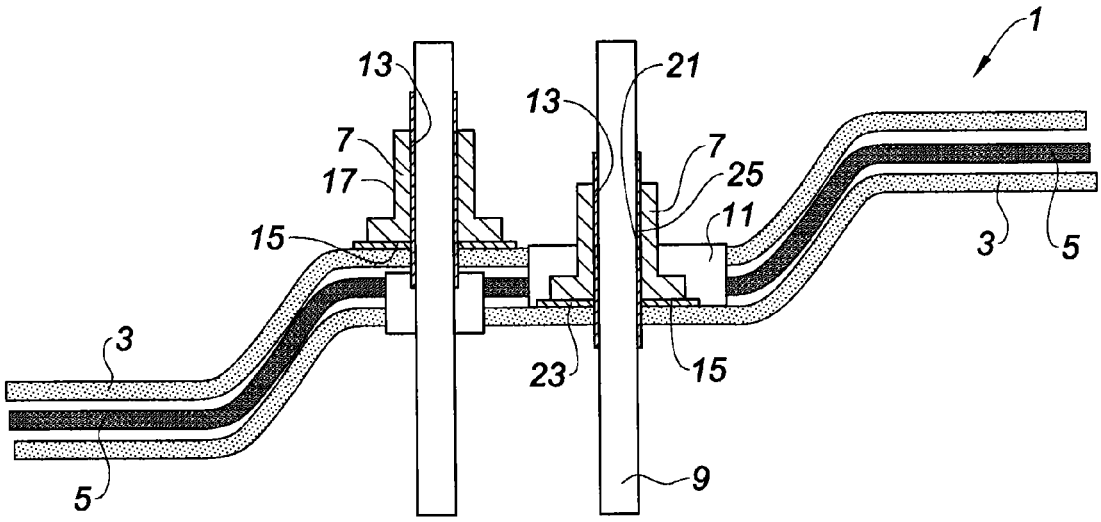

| | | | | |
|---|---|---|---|---|
| 4,906,198 | A * | 3/1990 | Cosimano | H01R 12/585 361/792 |
| 5,277,595 | A | 1/1994 | Clark | |
| 2004/0192084 | A1 | 9/2004 | Fronk | |
| 2006/0216971 | A1 | 9/2006 | Schuldt | |
| 2009/0314522 | A1 | 12/2009 | Janesch et al. | |

* cited by examiner

ELECTRICAL CIRCUIT FOR THE INTERCONNECTION OF AN ELECTRICAL COMPONENT, SUCH AS A POWER COMPONENT

TECHNICAL FIELD

The invention relates to an electrical circuit comprising flexible electrical circuits known as flex circuits, and to the application of this circuit in interconnecting power converters intended in particular to be on board and in particular integrated into harsh environments and into the management of currents of between 1 A and 200 A.

The invention relates in particular to the control electronics of actuators on aircraft, such as braking actuators, flight control actuators, etc.

PRIOR ART

Currently, low-power converters are generally formed by power switches which ensure the modulation of the transfer of energy from one electrical network to the other, by decoupling capacitors which absorb the transfer modulation of energy and by electronics which control these switches according to a logic defined by the user. The transfer of energy is controlled by transfer modulation, referred to as switching, which consists in alternating the coupling and decoupling of the two networks, one network of which is treated by the switches as a voltage source and the other network as a current source.

Integrating the power switches with the decoupling capacitors is a key point in the operation of the system, since the dynamics of the currents for switching the current source by means of the power switches is significant.

This dynamics of the currents may cause overvoltages at the switches of several tens or even hundreds of volts if the inductance of the interconnection between the power switches and the decoupling capacitor is not adjusted. These overvoltages may degrade the efficiency of the electrical conversion, degrade the switches and radiate excessively.

The solutions that are currently used to limit the problems related to overvoltages are those of positioning the metal elements which are conductive to the voltage source so as to minimise the inductance of a parasitic interconnection between the power switches and the decoupling capacitor, in particular by superposing said conductive elements.

Nowadays, low-power converters are produced from power components referred to as 'separate' and from passive components such as capacitors and inductors, and are integrated into rigid multi-layered printed circuit boards (PCB), or are produced from power modules and from passive components that are interconnected via an electrical circuit having a rigid busbar formed by conductive layers separated from one another by layers of electrical insulating material.

Currently, on-board electronic devices always need to be better integrated, in particular in aeronautical applications, thereby involving two constraints:

- the physical structure of these devices needs to be adapted to the space available, thereby resulting in physical complex assemblies being produced using the current means, which assemblies are not very physically adaptable since the PCB and busbar devices have a physical structure that is generally planar in nature;
- the physical structure of these devices also needs to resist an increase in the ambient temperature linked to the nature of the function, which is that of converting, in a confined space, more electrical energy and at a certain level of efficiency, thereby causing heating.

This heating of the system associated with the rigid connection of the assembly of the power components causes thermomechanical constraints linked to the integration of the multiple materials together (metal materials, polymer materials, etc.) which each have different thermal expansion constants, and said heating is therefore likely to impose significant thermomechanical constraints on the contact parts, in particular the soldered contact joints of the assembly, thereby limiting the service life and the reliability thereof.

Thus, the conventional electrical devices for interconnecting electrical converters have a limited operating temperature and therefore are not suitable for environments which are subject to heating.

Currently, these devices are generally produced either by assembling 'separate' components such as PCBs, or by a busbar.

'Separate' power components, for example electrical modules having pins, are mounted on a rigid PCB formed by a succession of insulating and conductive layers. The control for the power components is generally integrated on this board.

This assembly solution, which is practical and cost-effective, is generally used to produce low-or medium-power converters. In addition, it allows the interconnection of the power components and the control components to be integrated. However, this solution for assembling the components does not allow said components to be physically integrated into the three axes of space or in 3D, and the service life and operational reliability thereof remain limited, in particular in the case of high and/or frequent temperature cycling during operation.

When mounting using a busbar, the power components are generally connected to a rigid base which can be shaped by folding and are generally formed by conductive layers separated by electrical insulating layers. The connection to the control of the components is made via connectors on power modules. These assemblies are expensive, since they are generally used to produce medium-and high-power converters. They make 3D integration of the components possible, but this remains limited. Moreover, the removable interconnecting means of the screw and nut type which may be used limit the mechanical integration of the components and increase the assembly costs.

SUMMARY OF THE INVENTION

The problem addressed by the invention is that of producing an interconnection of power components on on-board electrical circuit assemblies, which are in particular integrated into harsh environments and ensure the management of currents that are greater than 1 A and less than 200 A.

An electrical circuit according to claim 1 is proposed.

'Homogenous current density' means a current density that is substantially constant at any point on the contact surface.

Said current density is advantageously between 4.5 and 5.5 $A/mm^2$, preferably between 4.8 and 5.2 $A/mm^2$ and in particular is equal to 5 $A/mm^2$.

An electrical circuit of this type thus allows an electrical power component to be connected to an electrical flex circuit, which is relatively flexible and therefore can be adapted in 3D in an available space, by limiting the current density at the contacts, thereby causing both the heating during current transmission at the contact parts and the mechanical constraints on the contact parts to be reduced.

Controlling the density at which the current passes over the contact parts of the components to the flex circuit therefore allows said circuit to sustain a greater electrical current than that of a conventional assembly, and therefore allows a power component to be connected to the flex circuit equipped in this manner at currents of between 1 and 200 A, in particular currents of from 30 to 80 A.

Said electrically conductive part is advantageously a metal part, preferably a copper, brass or aluminium part, comprising contact parts which are relatively large and solid, thereby allowing the density of the passage of the current to be controlled in the contact region and allowing the local concentrations of mechanical stress in this contact region to be absorbed.

The electrically conductive part may be in the shape of a cylindrical sleeve or a portion of a cylindrical sleeve, provided with a flat ring, the first contact part being formed by the cylindrical inner face of the sleeve or of the sleeve portion and the second contact part being formed by a face of the ring.

The width of said second contact part may in particular correspond to the width of the flex circuit. The length (transverse to the width) of the second contact part is thus adjusted to give a contact surface which is suitable for transmitting said electrical current density of less than 20 A/mm$^2$.

Furthermore, said electrically conductive part is advantageously shaped to allow the contact parts to be joined to the flex circuit and to the component, and such junction may be carried out in a specified joining method, for example soldering or brazing, electrical or laser welding or sintering, etc.

The first contact part may have a surface which is complementary to the contact element of the component, for example to the contact pin or tab of the component, and is shaped to come into contact with the contact element of the component, in particular said contact pin or said contact tab of the component.

The second contact part may have a planar surface that is shaped to come into planar contact with said conductive layer of the flex circuit.

The electrically conductive or current-diffusing part is advantageously in the shape of a cylindrical sleeve provided with a flat ring at one of its ends or over its periphery and is shaped to come into contact with a pin of the component on the cylindrical inner face of the sleeve and to come into contact with a conductive layer of the flex circuit on an outer face of the ring.

The first contact part is thus formed by at least part of the cylindrical inner face of the sleeve.

The second contact part is thus formed by said outer face of the ring.

The first contact part may also be in the shape of a portion of a cylinder and come into contact with an end part of a contact pin of the electrical component and over part of the cross section of the contact pin, and the second contact part is a flat ring which is applied by its outer surface to the surface of the lower conductive layer of the flex circuit.

The contact pin may further be mounted so as to pass through the flex circuit in part or in full, for example through a plated through hole or via of the flex circuit.

The flex circuit, formed by layers of copper which are insulated from one another by a layer of dielectric insulating material, advantageously has a thickness of less than approximately 30 micrometers, which allows the flex circuit to flex and twist, for example when adapting to the space available in an integrated environment, and to maintain at least one axis of freedom of the electrical component to which it is connected.

The flex circuit is advantageously formed by two layers of copper insulated from each other by an intermediate layer of dielectric insulating material.

In addition to said power component, the flex circuit may comprise other electrical components, for example one or more passive components, advantageously a circuit control component.

Said dielectric insulating material is advantageously a polyimide resin which is resistant to temperatures greater than 200° C., thereby making it possible to produce, in addition to an assembly soldered at a high temperature, thereby increasing the reliability and the service life of the assembly, an assembly that is resistant to heating in a confined environment.

The invention also relates to a new use of an electrical circuit as described above for interconnecting power converters intended in particular to be on board and in particular integrated into harsh environments.

Figure 2:
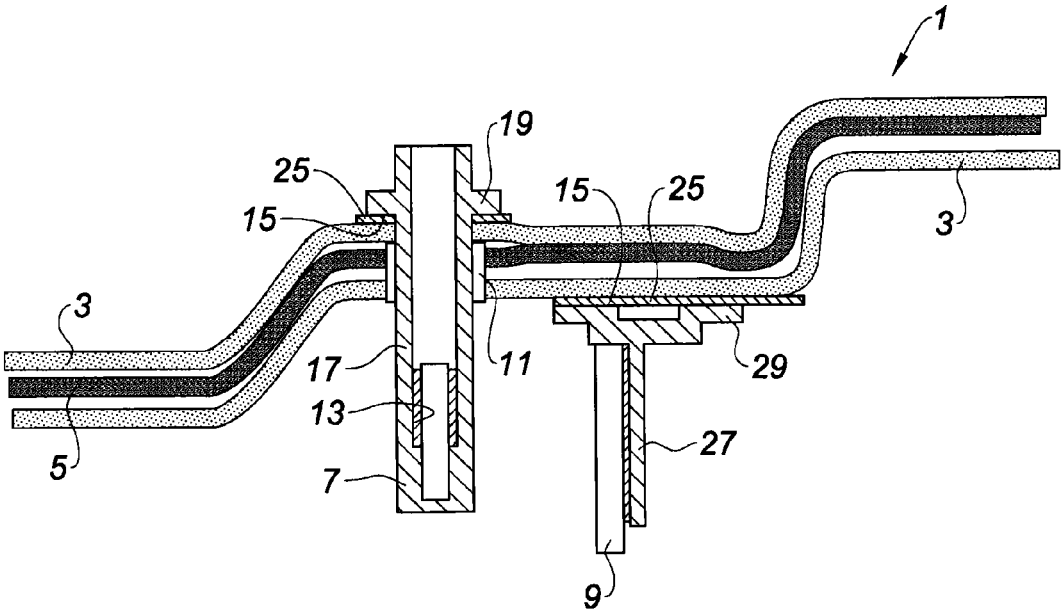

Embodiments of the invention are now described with reference to the accompanying drawings, in which:

FIG. 1 is an elevated schematic view of an electrical circuit according to an embodiment of the invention, and FIG. 2 is a view, similar to FIG. 1, of a variant.

DETAILED DESCRIPTION

Identical reference numerals used in the drawings relate to identical or technically equivalent elements.

The terms 'upper', 'intermediate' and 'lower' refer to the relative positioning in the standard mode of use or assembly.

The terms 'longitudinal' and 'transverse' specify elements extending in a given direction and in a plane perpendicular to this direction, respectively.

With reference to FIG. 1, the electrical circuit shown comprises a flex circuit 1, which is a double-sided flex circuit comprising two printed planar electrically conductive layers 3, for example made of copper. These conductive layers 3 are superposed and insulated from each other by a planar intermediate dielectric resin layer 5, having high heat resistance, for example of the polyimide type. In this case, the thickness of each of the conductive layers 3 and the insulating layer 5 is equal to approximately 10 micrometers. Therefore, the thickness of the flex circuit is approximately 30 micrometers, thereby giving said circuit the ability to flex and twist. The width of the circuit is equal to 3 to 5 centimeters, thereby allowing the circuit to transmit a current of 50 to 70 A for a current density passing through the flex circuit of less than 10 A/mm$^2$. A current of this type may in fact be that of an electrical component, for example that of a low- to medium-power component (not shown), as will be described below.

The flex circuit 1 comprises two parts 7 forming a contact interface between the flex circuit and the power component. These contact parts 7 are referred to hereinafter as electrical-current-diffusing devices.

The component may comprise two cylindrical contact pins 9 in the shape of a pin (only one is shown). These pins 9 are electrically connected to the flex circuit 1 by means of two electrically conductive parts or electrical-current-diffusing devices 7.

These electrical-current-diffusing devices 7 indeed connect each of the pins 9 of the electrical component to a respective conductive layer 3 of the flex circuit. These pins 9 are each arranged in a plated through hole or via 11 formed in the flex circuit, perpendicularly to the surface of said circuit. A lower via 11 on the flex circuit is thus formed for the left-hand pin 9 (on the left in the figure) and an upper via 11 on the flex circuit is formed for the right-hand pin.

The electrical-current diffusers 7 are identical, each consist of a metal part that is a good electrical conductor, preferably copper, and comprise two contact parts 13, 15 which are each configured to come into electrical contact with one of the pins 9 of the electrical component and with a conductive layer 3 of the flex circuit respectively.

In this case, the current-diffusing part 7 is in the shape of a cylindrical sleeve 17 provided with a flat ring 19 at one of its ends, and is shaped to come into contact with a pin 9 of the component on the cylindrical inner face 21 of the sleeve, and to come into contact with a conductive layer 3 of the flex circuit on an outer face 23 of the ring.

The first contact part 13 is thus formed by the cylindrical inner face 21 of the sleeve.

The second contact part 15 is thus formed by said outer face 23 of the ring.

The contact joint between the two contact parts 13, 15, to a pin 9 of the component and to a conductive layer 3 of the flex circuit respectively, is obtained by soldering to join the parts. This soldering builds up a conductive intermediate solder layer 25 between the opposing contact parts, said parts 13 corresponding to the pin 9 of the component and said parts 15 corresponding to the conductive layer 3 of the flex circuit, this conductive intermediate junction layer 25 slightly overlapping the exterior of each contact part 13, 15.

It can be seen in the figure that the current-diffusing part 7, owing to its solid appearance and the amount of its surface (of the part 15) that is in contact with the flex circuit, allows the electrical current density to be reduced in the contact regions, which density is adjusted to a value of less than 20 $A/mm^2$, preferably of between 4.5 and 5.5 $A/mm^2$, relative to the area of the contact parts 13, 15 that is in contact with the component and the flex circuit respectively. This feature reduces the heating of the contact connections and makes the connection assembly highly reliable.

In addition, the solid nature of the current diffusers 7 provides said diffusers with enough solidity for them to form a possible point of mechanical connection between the flex circuit and the component, allowing, for example, the flex circuit to be mechanically connected to the mounted electrical component, since the flex circuit can be deformed in order to adapt to the positioning of the component. Conversely, the possible flexing and twisting deformation of the flex circuit allows the component on the flex circuit to be given a certain level of freedom of positioning in order to adapt to the available space, in particular in the context of an integrated assembly.

The contact-diffusing parts 7 may be in another shape (see FIG. 2), as described above. The diffusing part 7, on the left in the figure, is always in the shape of a sleeve 17, but it is longer than in the previous case, since it is mounted so as to pass through the flex circuit through a through via 11 formed in the flex circuit. This diffusing part further comprises a contact ring 19 over its periphery, substantially in the upper part of the sleeve, this ring coming into contact on its lower face with the surface of the upper conductive layer 3 of the flex circuit.

The diffusing part 7, on the right in the figure, comprises a first contact part in the shape of a portion 27 of a cylinder, for example a half-cylinder, which comes into contact with an end part of the pin 9 and over part of its cross section (half), and the second contact part is a flat ring 29 which is applied by its outer surface to the lower conductive layer 3 of the flex circuit. According to this variant, the contact pins 9 are on the outside of the flex circuit 1, below said circuit.

The invention is not restricted to the embodiments described and shown. It is, for example, possible to provide other shapes for the contact parts of the current diffusers which are adapted to the (complementary) shape of the contact elements of the electrical component to be mounted.

The invention claimed is:

1. An electrical circuit comprising:

at least one electrical component, or a power electrical component;

an electrical flex circuit comprising a flexible conductive layer provided on a flexible insulating layer;

at least one electrically conductive part connecting the electrical component to the flex circuit, the electrically conductive part including at least one first contact part which receives a contact element of the electrical component to be in contact therewith, and a second contact part fixed to said flexible conductive layer of the electrical flex circuit to be in contact therewith, the width of the second contact part corresponding to the width of the flex circuit and the length being adjusted to give a contact surface that transmits an electrical current density of between 4.5 and 5.5 $A/mm^2$ and sustains a current suitable for the power component between 30 and 80 A.

2. An electrical circuit according to claim 1, wherein the first and second contact parts are shaped to transmit an electrical current density equal to 5 $A/mm^2$ between the surface of the contact parts which is in contact with the electrical component and the flex circuit.

3. An electrical circuit according to claim 1, wherein the electrically conductive part is a metal part, comprising contact parts that are relatively large and solid.

4. An electrical circuit according to claim 1, wherein the electrically conductive part is in a shape of a cylindrical sleeve or a portion of a cylindrical sleeve, including a flat ring, the first contact part being formed by a cylindrical inner face of the sleeve or of the sleeve portion, and the second contact part being formed by a face of the ring.

5. An electrical circuit according to claim 1, wherein the electrically conductive part is shaped to allow the contact parts to be joined to the flex circuit and the electrical component in a specified joining method, or soldering, or brazing, or electrical or laser welding, or sintering.

6. An electrical circuit according to claim 1, wherein the first contact part has a surface which is complementary to a contact element of the electrical component, or to a contact pin or tab of the electrical component, and is shaped to come into contact with the contact element of the electrical component, and the second contact part has a planar surface that is shaped to come into planar contact with the flexible conductive layer of the flex circuit.

7. An electrical circuit according to claim 4, wherein the electrically conductive part is a current-diffusing part which is in a shape of a cylindrical sleeve including a flat ring at one of its ends or over its periphery and which is shaped to come into contact with a pin of the electrical component on the cylindrical inner face of the sleeve and to come into contact with a conductive layer of the flex circuit on an outer face of the ring, the first contact part being formed by at least part of the cylindrical inner face of the sleeve and the second contact part being formed by the outer face of the ring.

8. An electrical circuit according to claim 1, wherein the first contact part is in a shape of a portion of a cylinder and comes into contact with an end part of a contact pin of the electrical component and over part of the cross section of the contact pin, and the second contact part is a flat ring which is applied by its outer surface to the surface of the lower conductive layer of the flex circuit.

9. An electrical circuit according to claim 1, wherein the flex circuit, which is formed by layers of copper that are insulated from one another by a layer of dielectric insulating material, has a cross-sectional thickness of less than approximately 30 micrometers.

10. An electrical circuit according to claim 9, wherein the dielectric insulating material is a polyimide resin.

11. A method of using an electrical circuit according to claim 1, comprising interconnecting power converters on board an aircraft and integrated into harsh environments.

* * * * *